US005425499A

United States Patent [19]

Pfieffer

[11] Patent Number: 5,425,499

[45] Date of Patent: Jun. 20, 1995

[54] THREE PIECE TRIANGULAR CARTON

[75] Inventor: Gerald R. Pfieffer, Seattle, Wash.

[73] Assignee: Jefferson Smurfit Corporation, Clayton, Mo.

[21] Appl. No.: 143,632

[22] Filed: Nov. 1, 1993

[51] Int. Cl.[6] ..... B65D 5/32

[52] U.S. Cl. ..... 229/115; 229/125.26

[58] Field of Search ..... 229/115, 107, 125.26, 229/117.02, 125.19

[56] References Cited

U.S. PATENT DOCUMENTS

| | | | |
|---|---|---|---|
| 648,008 | 4/1900 | Wellman | 229/115 |
| 1,726,682 | 9/1929 | Scholes | 229/125.19 |
| 2,298,146 | 10/1942 | Mersbach | 229/115 |
| 2,794,588 | 6/1957 | George et al. | 229/125.26 |
| 2,899,120 | 8/1959 | James | 229/125.26 |
| 3,157,343 | 11/1964 | Kendall | 229/115 |
| 3,361,323 | 1/1968 | Adams et al. | 229/125.26 |
| 4,359,182 | 11/1982 | Perkins, Jr. | 229/125.26 |
| 5,042,657 | 8/1991 | Dunn | 229/115 |

FOREIGN PATENT DOCUMENTS

| | | | |
|---|---|---|---|
| 151838 | 9/1951 | Australia | 229/115 |
| 747536 | 6/1933 | France | 229/115 |

*Primary Examiner*—Stephen P. Garbe
*Attorney, Agent, or Firm*—Richard W. Carpenter

[57] ABSTRACT

A three piece, non-glued, triangular paperboard carton for use in the packaging of retail products such as candy and perfumes. The carton has a central, hollow, tubular body with open ends that closed by a pair of similar top and bottom end caps, one of which has interlocking engagement with the body.

5 Claims, 2 Drawing Sheets

FIG. 6
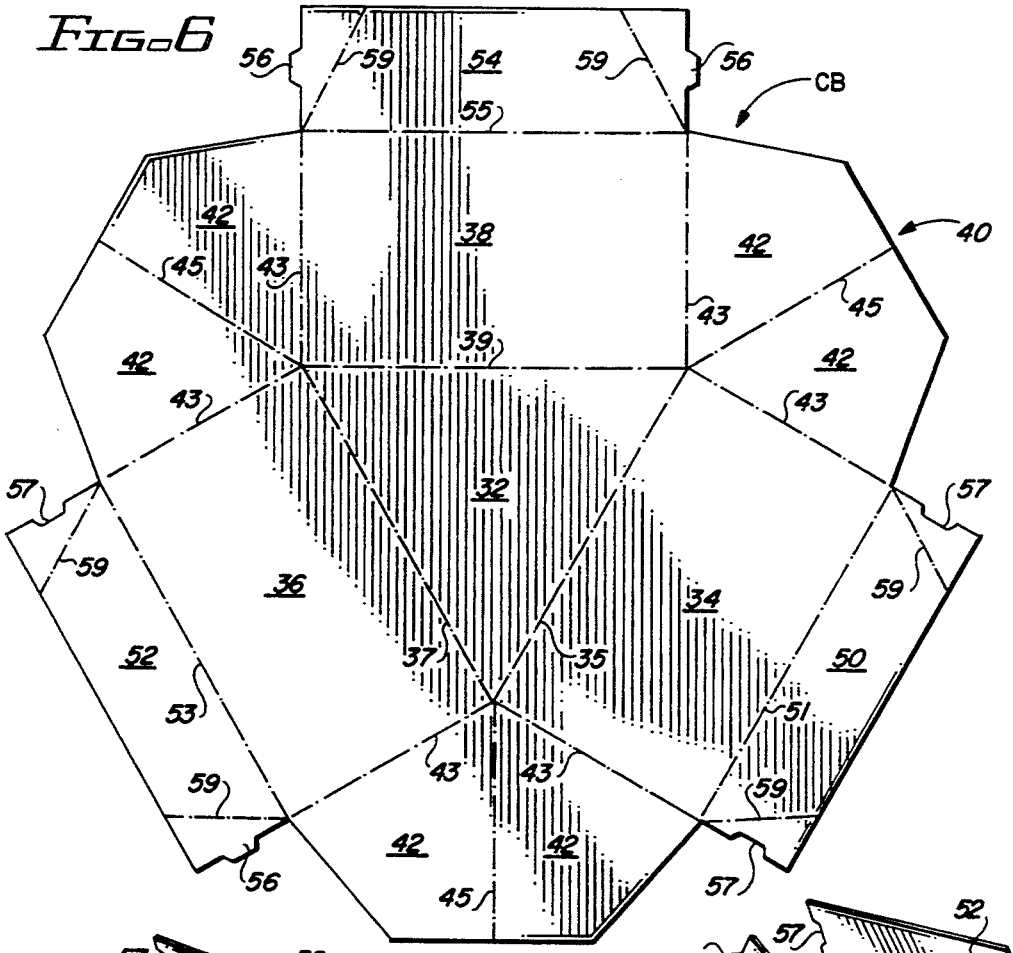
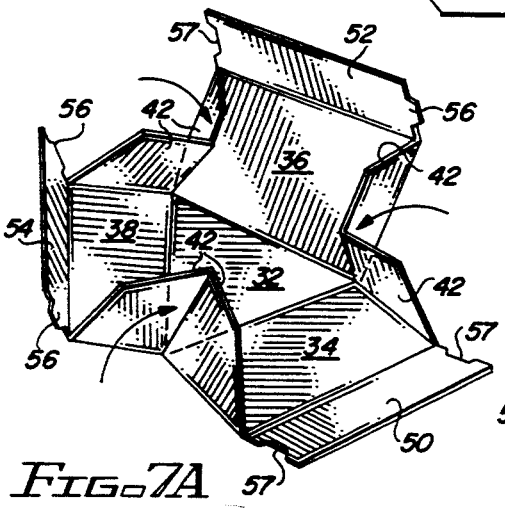
FIG. 7A
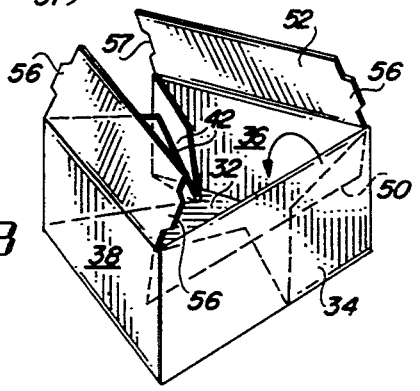
FIG. 7B
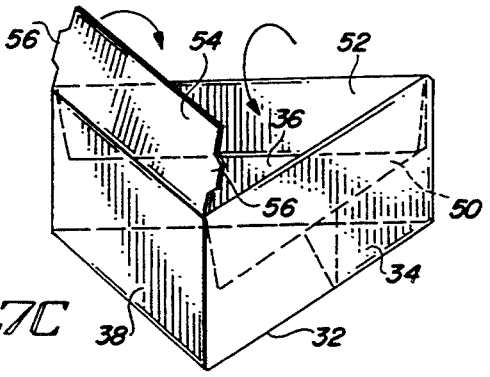
FIG. 7C

THREE PIECE TRIANGULAR CARTON

BACKGROUND OF THE INVENTION

1. Field of the Invention

This invention relates to folding cartons, and more particularly to a three piece, non-glued, decorative, paperboard carton of the type suitable for use in retail stores for the packaging of fancy or expensive products.

2. Description of the Background Art

A background art search directed to the subject matter of this invention conducted in the United State Patent and Trademark Office disclosed the following United States Letters Patent:

| | | | |
|---|---|---|---|
| 3,966,112 | 4,208,954 | 4,340,168 | 4,359,182 |
| 4,531,669 | 5.042,657 | 5,211,330 | |

None of the patents uncovered in the search discloses a three piece, non-glued, triangular carton having a central, hollow, tubular body with open ends closed by similar end caps, one of which has interlocking engagement with the body.

SUMMARY OF THE INVENTION

It is a primary object of the invention to provide a triangular, three piece, paperboard carton that includes a hollow, tubular body and a pair of hollow end caps enclosing the open ends of the body.

Another object of the invention is the provision of a carton of the type described that includes an interlocking connection between the body and one of the end caps.

Still another object of the invention is to provide a carton of the type describe that is decorative with finished edges, but which can be easily and quickly set up by hand without the need for the application of any adhesive, gluing operation.

These and other objects of the invention will be apparent from an examination of the following description and drawings.

BRIEF DESCRIPTION OF THE DRAWINGS

FIG. 6 is a plan view of the blank of foldable sheet material from which the end caps illustrated in the other views is formed;

FIGS. 7A, 7B, and 7C are perspective views illustrating the manner in which the end caps are erected from the carton blank.

It will be understood that, for purposes of clarity, certain elements may have been omitted from certain views where they are believed to be illustrated to better advantage in other views.

DESCRIPTION OF THE PREFERRED EMBODIMENT

Figure 1A:
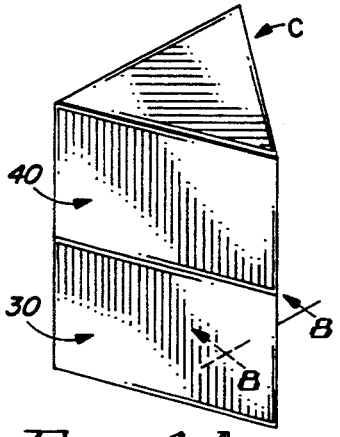
FIG. 1A is a fragmentary perspective of a three piece triangular carton embodying features of the present invention.
Figure 1B:
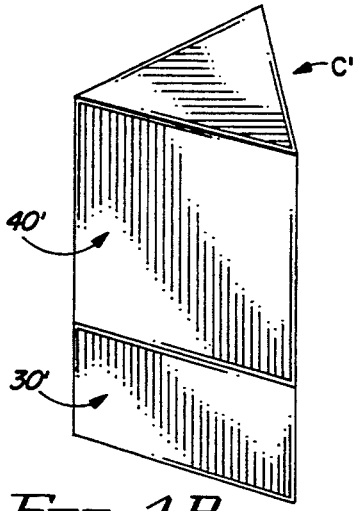
FIG. 1B is a view similar to that of FIG. 1A, but illustrating a modified form of the invention.
Figure 8:
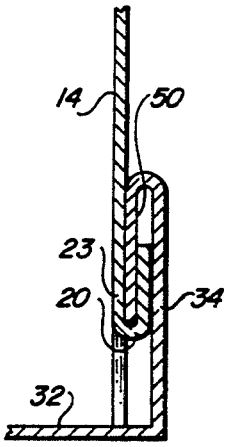
FIG. 8 is a fragmentary, vertical, sectional view taken on line 8—8 of FIG. 1.
Figure 2:
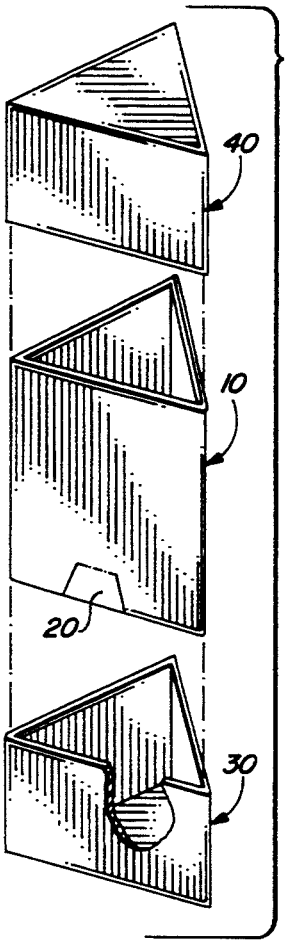
FIG. 2 is an exploded view of the carton of FIG. 1A.

Referring now to the drawings for a better understanding of the invention, and particularly to FIGS. 1A and 2, it will be seen that a carton embodying features of the invention, and indicated generally at C, includes a hollow, tubular body 10 with open upper and lower ends that are closed by upper and lower end caps 40 and 30, respectively.

Figure 3:
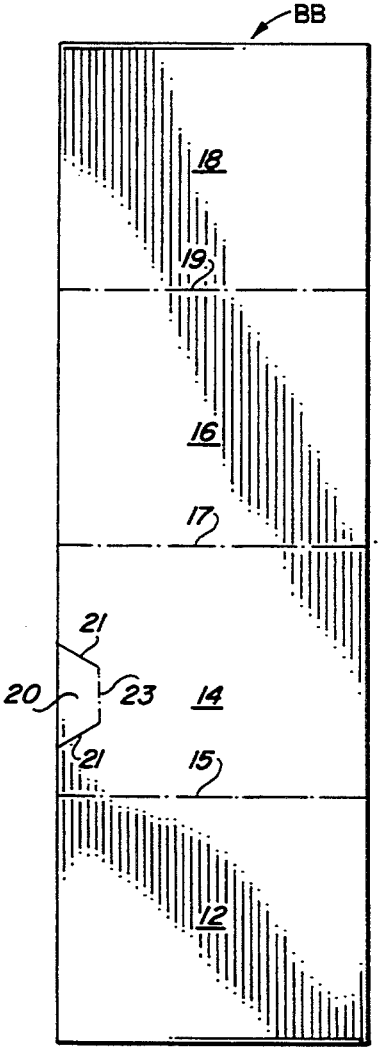
FIG. 3 is a plan view of the blank of foldable sheet material from which the carton body illustrated in the other views is formed.

The body, as well as the end caps, is triangular in cross-section and may be formed from the rectangular blank BB of foldable paperboard illustrated in FIG. 3.

Body 10 includes a first side wall inner panel 12, a second side wall 14, a third side wall 16, and a first side wall outer panel 18 which are serially arranged and foldably joined to each other along parallel fold lines 15, 17, and 19, respectively.

Still referring to FIG. 3, it will be seen that at least one of the body side walls includes, at its lower end, a lock flap 20 cut from material of the body side wall, and defined by a pair of laterally spaced cut lines 21 and a fold line 23 extending between the inner ends of the cut lines and located parallel to the lower edge of the side wall. The purpose of the lock flap is to provide an interlocking connection between the body 10 and the lower end cap 30, as described later.

To erect the body, the first side wall inner and outer panels are folded over into overlapping relation to provide a tubular structure, which when enclosed by the upper and lower end caps, as hereinafter described, does not require the use of any adhesive.

As best seen in FIGS. 2 and 6, end caps 30 and 40 are similar in construction and may, if desired, be identical in structure; the only difference being the omission of the diagonal scores 59, from the flanges of the upper cap, as hereinafter described.

Each end cap may be made from the blank CB of foldable paperboard illustrated in FIG. 3. The end cap includes a triangular center panel 32 having three generally rectangular first, second, and third side panels 34, 36, and 38 foldably joined to the outer edges of the center panel 32 along first, second, and third fold lines 35, 37, and 39, respectively.

Each pair of adjacent side panels are foldably joined to each other by a gusset, indicated generally at 40, which includes a pair of similar gusset sections 42 having outer side edges foldably joined along fold lines 43 to side edges of adjacent side panels, and having inner side edges foldably joined to each other along a fold line 45.

The end caps each also include first, second, and third inner flanges 50, 52, and 54, which are foldably joined to upper edges of first, second, and third cap side panels 34, 36, and 38 along fold lines 51, 53, and 55, respectively. The inner flanges are adapted to be folded inwardly 180 degrees to lie against the inner faces of the cap side panels to cover raw edges of the cap side panels and give the caps a finished appearance.

The inner flanges also serve to enclose portions of the gussets and at least one lock flap, as hereinafter described.

As best seen in FIGS. 6, 7A, 7B, and 7C certain of the end cap inner flanges are provided, at their ends, with end tabs 56 and/or tab recesses 57 to provide interlocking interconnection between adjacent ends of adjacent flanges when the carton end caps are erected.

Each of the end cap inner flanges may also be provided, inwardly adjacent its ends with diagonal score lines 59 which make it slightly easier to fold the flanges inwardly when the carton is erected. In certain cases it may be desirable, for purposes of appearance, to omit the score lines from the flanges of the upper end cap. Once the carton has been assembled, the score lines in the lower end cap are not visible.

In erecting the carton, the end caps are each formed first. Each end cap is formed from a blank CB by folding the gusset sections of each gusset together and then folding the inner flange of each end cap inwardly 180 degrees to overlie the related side wall and to sandwich one gusset between each inner flange and related side panel. The flange end tabs are pushed into adjacent end tab recesses to lock the flanges in place.

The folding sequence of the end caps is important to insure that one gusset in interposed between each flange and related side panel in each of the end caps. It is also important that the fold sequence for the upper and lower end caps be different.

The following sequence, which is illustrated in FIGS. 7A, 7B, and 7C, should be used for the lower end cap:

1. Right—fold in side panel 34 and trap gusset.
2. Right—fold in side panel 36 and trap gusset.
3. Fold in side panel 38 and trap gusset.

The following reverse sequence should be used for the upper end cap:

1. Left—fold in side panel 36 and trap gusset.
2. Left—fold in side panel 34 and trap gusset.
3. Fold in side panel 38 and trap gusset.

The purpose of the different fold sequence between the lower and upper end caps is to insure that the gussets are aligned, which in turn insures uniformity of thickness of the sides of each end cap, no matter in what position the cap is when it is attached to the body.

Figure 4:
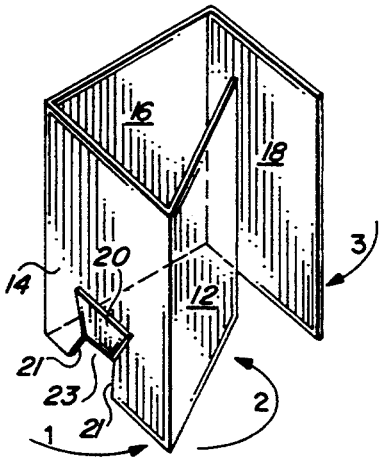
FIG. 4 is a perspective view illustrating the manner in which the carton body is formed.
Figure 5:
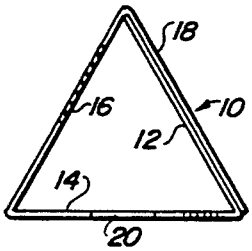
FIG. 5 is a top plan view of the carton body illustrated in the other views.

After the end caps have been formed, the body can be formed by folding the panels as illustrated in FIGS. 4 and 5, with the lock flap 20 folded upwardly, as shown in FIG. 4, for insertion into a lower end cap.

When the body has been formed, it can be inserted into the lower end cap with the lock flap sandwiched between one flange and related side panel of the end cap.

After the carton has been filled with a product the upper end cap can be inserted over the upper end of the carton body. The flange construction provides a finished look for the carton which is desirable in the retail trade for fancy or expensive products.

It will be appreciated that the carton design provides a construction that allows the carton to be formed from flat blanks that can be easily and quickly erected manually and which do not require adhesives or other fastening means.

What is claimed is:

1. A three-piece triangular carton formed from separate blanks of foldable paperboard, said carton comprising:

(a) a body including three side walls with side edges foldably joined to each other to form a hollow tubular structure with open upper and lower ends;

(b) a pair of hollow upper and lower end caps arranged and disposed to fit over and enclose said body upper and lower ends, respectively, each of said end caps including:

(i) a triangular center panel having three side edges;

(ii) three side panels, each having one end edge foldably joined to one of said center panel side edges, another end edge parallel to said first end edge, and a pair of side edges;

(iii) each of said side panels being foldably joined to an adjacent side panel by a gusset including a pair of gusset sections foldably joined to each other and to related side edges of respective adjacent side panels;

(iv) three inner flanges, each being foldably joined at one end edge to a second end edge of a related side panel, and being folded 180 degrees inwardly to overlie said related side panel;

(c) a lock flap cut from material of at least one of said side walls, adjacent a free edge thereof, foldably joined to said one side wall along a fold line extending parallel to said free edge, and folded outwardly 180 degrees to lie between an adjacent end cap side panel and related flange to provide an interlocking connection between said adjacent end cap and said body.

2. A carton according to claim 1, wherein said body and both end caps are self contained, so as to require no adhesive or other outside fastening means for assembly.

3. A carton according to claim 1, wherein each of said end cap gussets is interposed between an adjacent one of said side panels and a related inner flange.

4. A carton according to claim 1, wherein said end cap inner flanges have interlocking connections with adjacent inner flanges.

5. A carton according to claim 4, wherein said interlocking connections are provided by complementary tabs and recesses located at related ends of adjacent flanges.

* * * * *